US006098537A

United States Patent [19]

Nakayama et al.

[11] Patent Number: 6,098,537

[45] Date of Patent: Aug. 8, 2000

[54] STENCIL PRINTER HAVING BACK PRESS ROLLER WITH CLAMP AND MOVABLE WALL MEMBER

[75] Inventors: Koji Nakayama; Yasuhiro Takahashi, both of Inashiki-gun, Japan

[73] Assignee: Riso Kagaku Corporation, Tokyo, Japan

[21] Appl. No.: 09/100,255

[22] Filed: Jun. 19, 1998

[30] Foreign Application Priority Data

Jun. 24, 1997 [JP] Japan ..... 9-183113

[51] Int. Cl.[7] ..... B41L 13/06; B41F 21/04

[52] U.S. Cl. ..... 101/118; 101/116; 101/246; 101/409

[58] Field of Search ..... 101/116, 117, 101/118, 119, 120, 246, 126, 409

[56] References Cited

U.S. PATENT DOCUMENTS

| | | | |
|---|---|---|---|
| 4,911,069 | 3/1990 | Hayama et al. | 101/120 |
| 5,243,904 | 9/1993 | Hayama et al. | 101/120 |
| 5,483,878 | 1/1996 | Hanzawa | 101/118 |
| 5,555,802 | 9/1996 | Ohinata et al. | 101/116 |
| 5,669,298 | 9/1997 | Negishi et al. | 101/119 |
| 5,671,670 | 9/1997 | Takahashi et al. | 101/116 |
| 5,671,671 | 9/1997 | Wyssmann et al. | 101/120 |
| 5,690,027 | 11/1997 | Takahashi et al. | 101/120 |

FOREIGN PATENT DOCUMENTS

| | | |
|---|---|---|
| 1-204781 | 8/1989 | Japan . |
| 2-225078 | 9/1990 | Japan . |
| 4-105984 | 4/1992 | Japan . |
| 4-361043 | 12/1992 | Japan . |
| 7-137415 | 5/1995 | Japan . |
| 7-137416 | 5/1995 | Japan . |
| 7-137419 | 5/1995 | Japan . |
| 9-39359 | 2/1997 | Japan . |

*Primary Examiner*—Edgar Burr
*Assistant Examiner*—Leslie J. Grohusky
*Attorney, Agent, or Firm*—Oliff & Berridge, PLC

[57] ABSTRACT

In a stencil printer, in order to definitely prevent an ink leakage even when the perforated portion 20*c* of the printing drum laps over the clamp 25 of the back press roller 14, the portions of a part of the outer circumferential surface of the back press roller positioned adjacent to the rear and opposite side edges of the clamp 25 is provided by a movable circumferential member 66 adapted to bias rearward relative to the clamp in synchronization with the opening operation of the clamp, so as thereby to cancel the clearance formed along the periphery of the clamp without obstructing the opening operation of the clamp.

4 Claims, 4 Drawing Sheets

STENCIL PRINTER HAVING BACK PRESS ROLLER WITH CLAMP AND MOVABLE WALL MEMBER

BACKGROUND OF THE INVENTION

1. Field of the Invention

The present invention relates to a stencil printer, and more particularly, to a structure for preventing an ink leakage from a printing drum.

2. Description of the Prior Art

Stencil printers having such a basic construction as comprising a printing drum having a perforated construction in a circumferential portion thereof excluding two annular edge portions at opposite ends of a cylindrical configuration and a stencil sheet leading end mounting bar portion extending between the two annular edge portions along a generatrix of the cylindrical configuration, an inking roller provided inside the printing drum to supply ink to the perforated circumferential portion of the printing drum from the inside thereof, and a back press roller, wherein the printing drum and the back press roller are arranged close and in parallel to one another to be rotated mutually in opposite rotational directions, so as to apply a stencil printing onto a print sheet transferred through a nip region between the printing drum and the back press roller, have been proposed by Japanese Patent Application 63-28553 (Laid-open Publication 1-204781), Japanese Patent Application 1-47029 (Laid-open Publication 2-225078), Japanese Patent Application 2-223550 (Laid-open Publication 4-105984), etc., filed by the same assignee as the present application Further, it has been proposed by Japanese Patent Application 3-162218 (Laid-open Publication 4-361043) filed by the same assignee as the present application to provide a print sheet leading end holding clamp in the back press roller of a stencil printer of the above-mentioned basic construction to accomplish a stencil printing capable of producing a clear print image without causing a back contamination of the print sheet by the ink of the print image of an adjacent print sheet when the printed sheets are stacked one over the other, according to the principle that the print sheet is pulled apart from the perforated portion of the printing drum while the inking roller is inhibiting any movement of an ink layer formed in the perforated portion of the print sheet. Still further, it has been proposed by Japanese Patent Application 7-214075 (Laid-open Publication 9-39359) filed by the same assignee as the present application to mount an elastic strip sheet at an outer circumferential surface of the back press roller along a generatrix thereof to prevent the ink from leaking into a clearance formed in an outer circumferential portion of the back press roller for receiving a rear edge portion of the clamp when it is inclined rearward to open, particularly even when the clamp laps over the perforated portion of the printing drum according to a relative rotational biasing between the printing drum and the back press roller for a longitudinal or up/down positional adjustment of a print image on a print sheet as proposed to be available by Japanese Patent Application 5-306033 (Laid-open Publication 7-137419) by the same assignee as the present application.

The accompanying FIG. 1 is a diagrammatical view showing an already publicly known basic construction of a stencil printer comprising a printing drum, an inking roller and a back press roller having a print sheet leading end holding clamp of the above-mentioned constructions. In the figure, 10 is the printing drum, and 14 is the back press roller. The printing drum 10 has axially opposite end portions formed of a pair of annular portions 16 which are connected with one another by a transverse bar portion 18 extending in parallel with the central axis of the printing drum, so as to construct a frame of the printing drum. A flexible perforated sheet 20 having a rectangular configuration in development is mounted to the frame with its opposite side edge portions being placed on the outer circumferential surfaces of the pair of annular portions 16, while its leading end portion 20*a* and its trailing end portion 20*b* are respectively mounted to the bar portion 18. Although in the figure the mounting of the leading end portion 20*a* and the trailing end portion 20*b* of the flexible perforated sheet to the bar portion 18 is diagrammatically shown as they are simply laid one over the other at a portion thereof, some particular constructions with respect to the mounting of the trailing end portion 20*b* to the bar portion 18 are shown in the above-mentioned Japanese Patent Application 1-47029 (Laid-open Publication 2-225078) and other Japanese patent applications such as Japanese Patent Application 5-306028 (Laid-open Publication 7-137415) and Japanese Patent Application 5-306029 (Laid-open Publication 7-137416) filed by the same assignee as the present application. A stencil sheet 19 is wrapped around the cylindrical surface of the printing drum 10 formed by the flexible perforated sheet 20 in a condition that its leading end is held by a clamp 21 of the above-mentioned type.

The leading end portion 20*a* and the trailing end portion 20*b* of the flexible perforated sheet 20 have each a non-perforated construction, while a central portion 20*c* has a perforated construction to let ink pass thereacross. A stencil leading end mounting portion 10*a* of a non-perforated construction in the form of a strip bar extending between the opposite ends of the printing drum 10 along a generatrix thereof is formed by a combination of the non-perforated leading and trailing end portions 20*a* and 20*b* of the flexible perforated sheet 20 and the bar portion 18.

On the other hand, the back press roller 14 is formed with a transverse groove 22 extending in parallel with the central axis thereof along a generatrix thereof. The printing drum 10 and the back press roller 14 are common in the size of diameter and are rotated mutually in opposite rotational directions in synchronization with one another in such a manner that the stencil sheet leading end mounting portion 10*a* of the printing drum and the transverse groove 22 of the back press roller align with one another. When viewed in FIG. 1, the printing drum rotates in the counter-clockwise direction, while the back press roller rotates in the clockwise direction.

Inside the printing drum 10, an inking roller 12 is mounted by a shaft 13 to be rotatable about its central axis, with its outer circumferential surface contacting the inner circumferential surface of the printing drum 10. In order to avoid that the inking roller 12 impulsively contacts the transverse bar portion 18 during rotations of the printing drum, a pair of cams 24 are provided along the pair of annular portions 16, while a pair of annular cam followers 23 to engage the cams are provided on the shaft 13 of the inking roller 12.

A clamp 25 is provided in the back press roller 14 adjacent to a rear edge of the transverse groove 22 as viewed along the rotational direction of the back press roller, to clamp the leading end of a print sheet onto the back press roller 14. By this arrangement, each print sheet is mounted on the back press roller 14 in such a manner that it is held at the leading end by the clamp 25, while the print sheet is transferred through a nip region between the press roller and the printing drum, starting from the clamped leading end, as the back press roller 14 rotates in the clockwise direction, with a print image being applied thereon by the ink supplied by the inking roller 12 to the inside of the flexible perforated sheet 20 and passed through the perforations of the flexible perforated sheet 20 and perforations of the stencil sheet 19.

In the case where the above-mentioned longitudinal or up/down positional adjusting means for the print image relative to the stencil sheet proposed by the above-mentioned Japanese Patent Application 5-306033 (Laid-open Publication 7-137419) is incorporated, when the printing drum 10 and the back press roller 14 are set at a standard condition with respect to the relative rotational position therebetween, a border point (actually a line) 26 between the perforated portion 20*c* and the non-perforated leading end portion 20*a* of the flexible perforated sheet is in alignment with a point (actually a line) 28 on the outer circumferential surface of the back press roller 14, and similarly, a border point (actually a line) 32 between the perforated portion 20*c* and the non-perforated rear end portion 20*b* of the flexible perforated sheet is in alignment with a point (actually a line) 34 on the outer circumferential surface of the back press roller 14. When the relative rotational position between the printing drum 10 and the back press roller 14 is varied for an adjustment of the longitudinal or up/down position of a print image, the corresponding points (lines) 28 and 34 on the back press roller 14 bias as shown by arrows 38 and 40, respectively, so that there can occur a condition that the perforated portion 20*c* of the flexible perforated sheet laps over the clamp 25.

In more detail, when there occurs the condition that the perforated portion 20*c* of the flexible perforated sheet laps over the clamp 25, since a relatively large clearance 27 is formed along the rear edge of the clamp 25 holding the leading end of a print sheet S as shown in FIG. 2 to allow for an inclining movement of the clamp, when the ink of the ink layer L in this region is pressed by the inking roller 12 from the inside of the perforated portion 20*c*, the ink is pushed out through the perforations of the perforated portion 20*c* to the inner side of the stencil sheet 19 with no sufficient back support for the stencil sheet, so that a substantial amount of ink will be pressed into a space between the perforated portion 20*c* and the stencil sheet, thus locally bulging the stencil sheet outward. When such a pressing out of the ink has once occurred, the pressed out ink does not return by itself to the inside of the perforated portion 20*c* even after the ink pressing action of the inking roller was cancelled, because the ink has a relatively high viscosity. Therefore, when such a phenomenon is repeated according to the rotations of the printing drum, the ink flows unidirectionally from the inside to the outside of the perforated portion 20*c* thereacross, accumulating between the outer circumferential surface of the printing drum and the stencil sheet. As will be clear from FIG. 2, such a leaking out of the ink due to the lack of back pressing at the clearance 27 occurs in the same manner even in the printer in which the perforated portion 20*c* has a rigid perforated construction. When such an ink accumulation progresses, there not only occurs an ink contamination therearound but, when it progresses much, the stencil sheet is strongly pressed against an edge of the clamp or the clamp mounting opening, thereby causing a damage of the stencil sheet, probable to proceed so far as to cause a breakage of the stencil sheet.

In order to meet with such a problem, in Japanese Patent Application 7-214075 (Laid-open Publication 9-39359) filed by the same assignee as the present application, it has been proposed to mount an elastic strip sheet 52 at a portion of the outer circumferential surface of the back press roller 14 along a generatrix thereof so as to cover the clamp 25 as shown in FIG. 3.

Although the elastic strip sheet 52 according to the former proposal generally accomplishes the object intended, the elastic strip sheet 52 is liable to a flexing, so that when the printer is operated for a long time in the condition that the perforated portion 20*c* of the flexible perforated sheet is laid over the clamp 25, it is apprehended that there still occurs an ink leakage by the same mechanism as described with reference to FIG. 2, due to a flexing of the elastic strip sheet 52.

SUMMARY OF THE INVENTION

In view of the above, it is a primary object of the present invention to provide a further improved stencil printer in which the ink leakage according to the above described mechanism is more definitely prevented.

According to the present invention, such a primary object of the present invention is accomplished by a stencil printer comprising a printing drum having a perforated construction in a circumferential portion thereof excluding two annular edge portions at opposite ends of a cylindrical configuration and a stencil sheet leading end mounting bar portion extending between the two annular edge portions along a generatrix of the cylindrical configuration, an inking roller provided inside the printing drum to supply ink to the perforated circumferential portion of the printing drum from the inside thereof, and a back press roller having a print sheet leading end holding clamp in an outer circumferential surface thereof along a generatrix thereof, wherein the printing drum and the back press roller are arranged close and in parallel to one another to be rotated mutually in opposite rotational directions, so as to apply a stencil printing onto a print sheet transferred through a nip region between the printing drum and the back press roller with a leading end thereof being held by the clamp, the stencil printing being formed by the ink supplied from the inking roller to flow across the perforated portion of the printing drum and a perforated stencil sheet wrapped around the printing drum, characterized in that a portion of the outer circumferential surface of the back press roller in an area thereof adjacent to a rear and opposite side edges of the clamp is provided by a circumferential wall member movable to bias rearward relative to the clamp when the clamp is opened.

Further, the above-mentioned primary object is more effectively accomplished by a stencil printer of the above-mentioned construction, wherein the circumferential wall member is constructed to incline in a same angular direction as the clamp when the member biases rearward relative to the clamp, and an elastic strip member is mounted to the circumferential wall member so as to cover the clamp when the clamp is closed.

When a portion of the outer circumferential surface of the back press roller in an area thereof adjacent to a rear and opposite side edges of the clamps is provided by a circumferential wall member movable to bias rearward relative to the clamp when the clamp is opened, as in the above-mentioned constructions, a clearance such as the clearance 27 shown in FIGS. 2 and 3 for allowing an inclination of the clamp in its opening operation can be substantially cancelled, so that even when the stencil printer is operated in the condition that the perforated portion 20*c* laps over the clamp 25, the stencil sheet can be firmly supported at its outside with no such clearance as in the prior art, thereby definitely preventing the ink leakage according to the above-mentioned mechanism.

Further, when the circumferential wall member is constructed to incline in the same angular direction as the clamp when the member biases rearward relative to the clamp, while an elastic strip member such as the elastic strip sheet 52 shown in FIG. 3 is mounted to the circumferential wall member so as to cover the clamp when the clamp is closed, even when a small clearance remains between the clamp and those portions of the movable circumferential wall member facing the rear and opposite side edges of the clamp to avoid any frictional contact therebetween, the stencil sheet is more firmly and smoothly supported across such a clearance by the elastic strip sheet, thereby more definitely preventing the ink leakage according to the above-mentioned mechanism. Since in this case the circumferential wall member inclines in the same angular direction as the clamp when the clamp is opened, the elastic strip sheet retreats rearward of the clamp therefrom in accordance with the movement of the circumferential wall member, so that the opening operation of the clamp is much less interfered by the elastic strip sheet.

BRIEF DESCRIPTION OF THE DRAWINGS

In the accompanying drawings.

DESCRIPTION OF THE PREFERRED EMBODIMENTS

Figure 1:
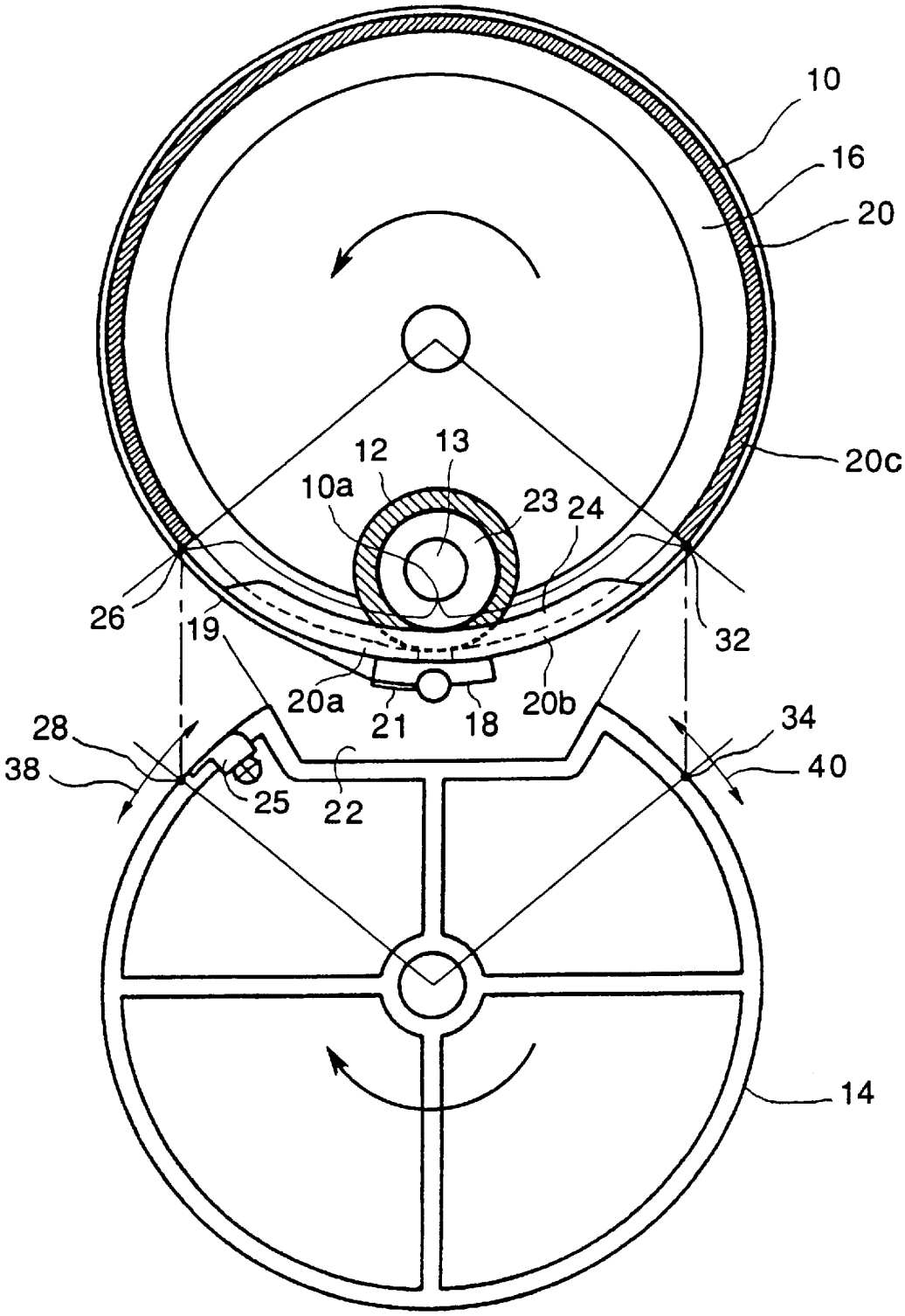
FIG. 1 (PRIOR ART)
FIG. 1 is a diagrammatical view showing an essential portion of the basic construction of a printing drum to which the present invention is directed.
Figure 2:
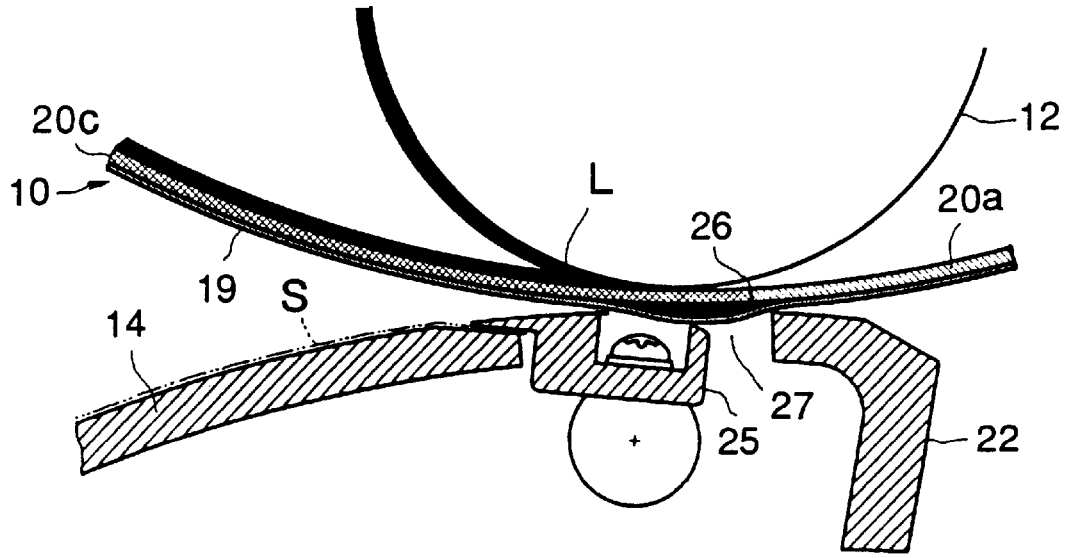
FIG. 2 (PRIOR ART)
FIG. 2 is an enlarged view of a part of the stencil printer having the basic construction shown in FIG. 1, illustrating a problem concerned therewith.
Figure 3:
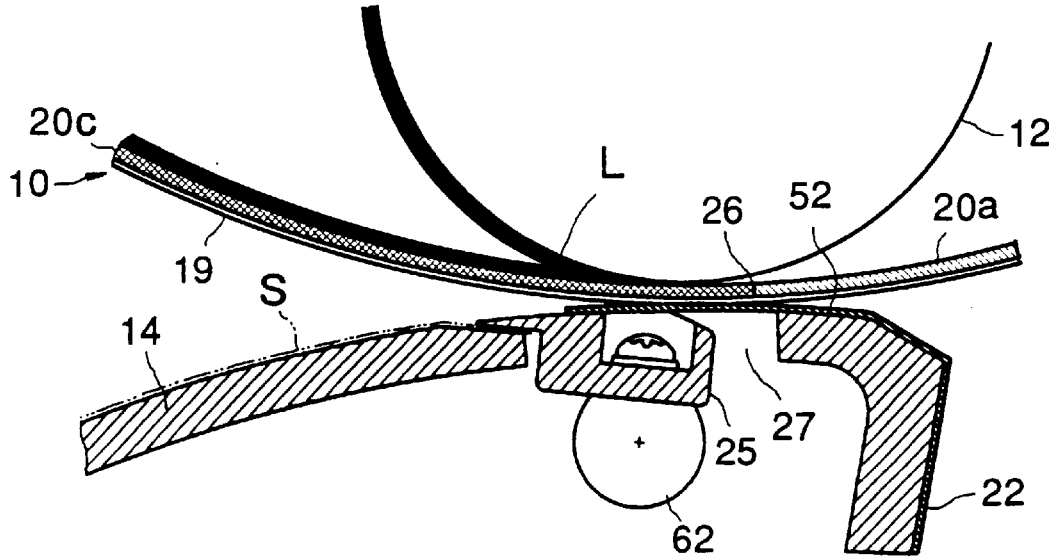
FIG. 3 (PRIOR ART)
FIG. 3 is an enlarged view of a part of the stencil printer having the construction according to a prior application publicly known before the present application, meeting with the above-mentioned problem.
Figure 4:
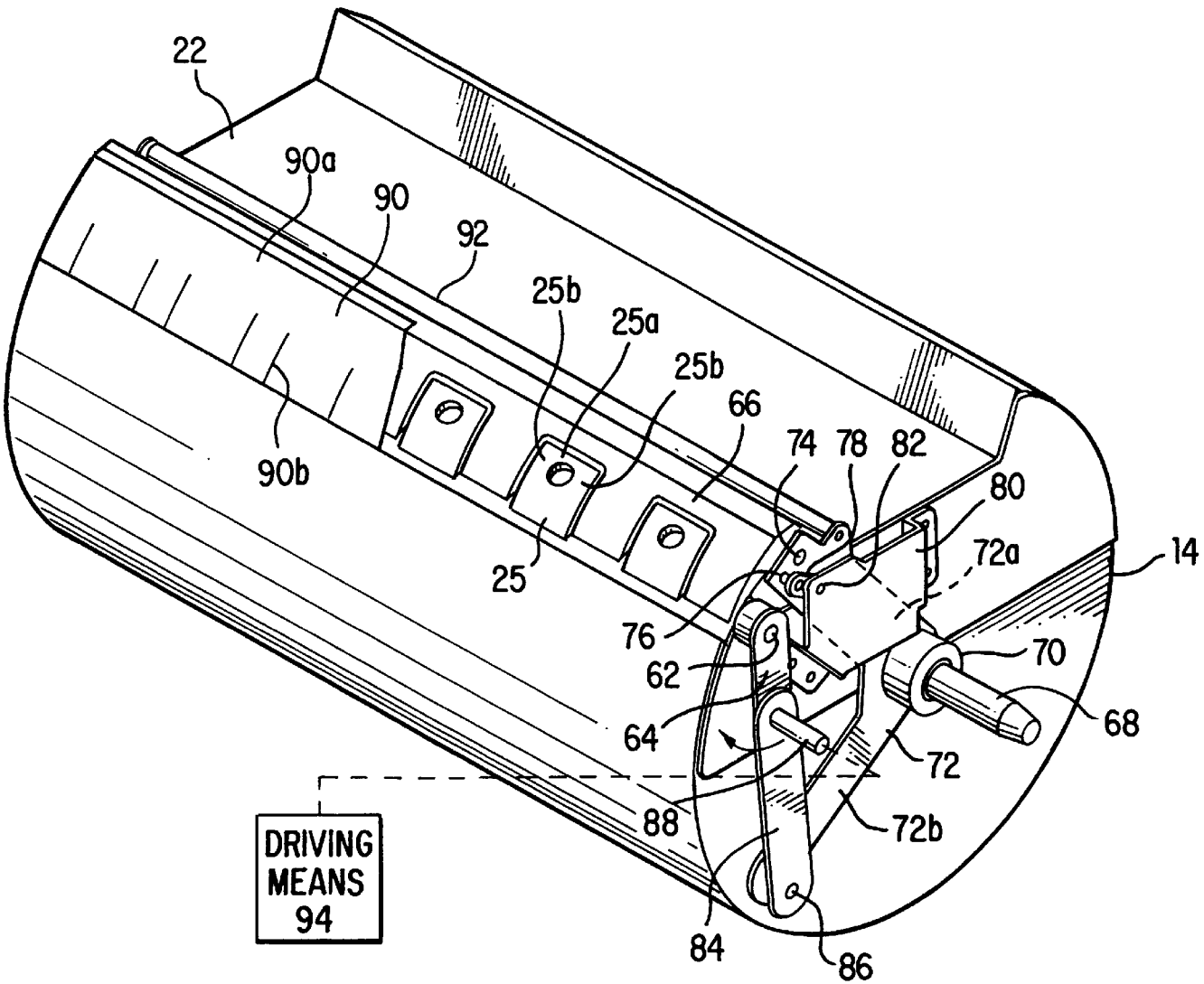
FIG. 4 is a perspective view of a back press roller incorporating an embodiment of the present invention, together with its modification.
Figure 5:
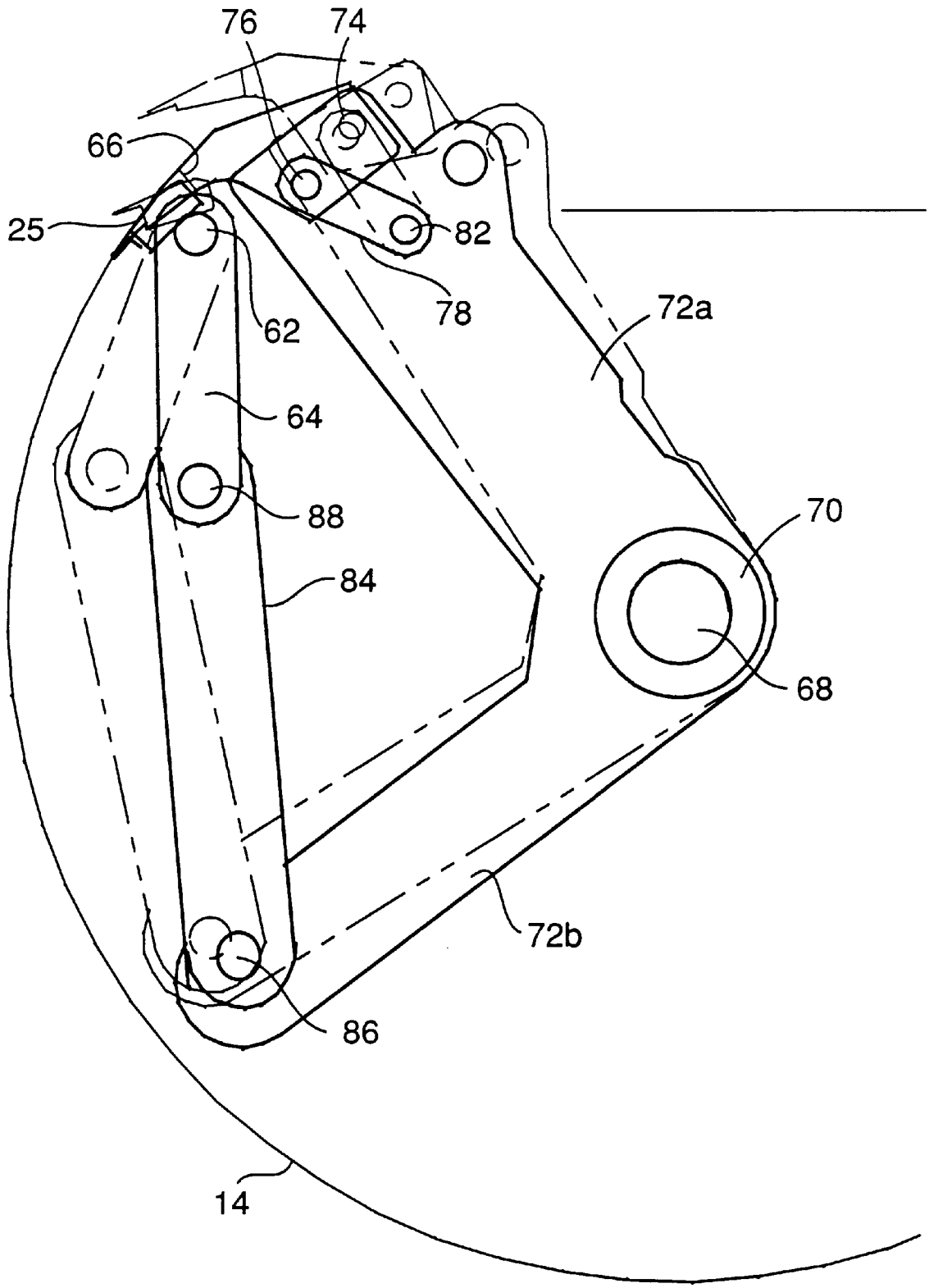
FIG. 5 is an enlarged view showing a link mechanism shown in FIG. 4, illustrating its operation.

Referring to FIG. 4 showing an embodiment of the stencil printer according to the present invention wherein the figure shows its back press roller in which the above-mentioned movable circumferential wall member according to the present invention is incorporated, and FIG. 5 diagrammatically illustrating a link mechanism shown in FIG. 4 with regard to its operation, the portions corresponding to those shown in FIGS. 1–3 are designated by the same reference numerals as in those figures.

The clamp 25 is provided as a plurality of clamps distributed along a shaft 62 which supports and turns those clamps, so that according to a turn of the shaft 62 in the clockwise direction, as viewed in the front of the back press roller 14 in FIG. 4, by a link 64 connected thereto at its one end, the clamps are all inclined toward their open position shown by a phantom line in FIG. 5. Those portions of the outer circumferential surface of the back press roller 14 located adjacent to the rear edge 25*a* and the opposite side edges 25*b* of each of the clamps 25 are provided by a movable circumferential wall member 66. The circumferential wall member 66 is pivotably mounted to a tip portion of one leg portion 72*a* of an L-shaped link 72 by a pin 74, the L-shaped link 72 being rotatably mounted by its hub portion 70 on a shaft 68 of the back press roller 14. A pin 76 is planted to an axial end portion of the circumferential wall member 66, wherein the pin 76 loosely penetrates an opening formed at a corresponding portion of the leg portion 72*a* of the L-shaped link 72, and is pivotably connected with an end of a link 78, another end of which is pivotably connected to aportion of a bracket 80 fixed to an axial end wall of the back press roller 14 by a pin 82. A free end of another leg portion 72*b* of the L-shaped link 72 is pivotably connected with an end of a link 84 by a pin 86. Another end of the link 84 is pivotably connected with another end of the link 64 by a pin 88.

In the above-mentioned construction, when the clamps 25 are to be opened, the pin 88 is driven around the shaft 62 in the clockwise direction as shown by an arrow in FIG. 4 by a driving means 94, whereby the clamps 25 supported by the shaft 62 turn around the central axis of the shaft 62 for an angle corresponding to the rotational angle of the shaft 62 from the closed position shown in FIG. 4 toward an open position.

When the pin 88 is driven as described above, the L-shaped link 72 is turned around the shaft 68 in the clockwise direction as viewed in the figure by way of the link 84, and in accordance therewith the circumferential wall member 66 supported by the tip end portion of the leg portion 72*a* is biased rearward relative to the clamps 25, so as not to prevent that the rear edges of the clamps 25 bias rearward according to the inclination thereof. During the rearward biasing relative to the clamps 25, the circumferential wall member 66 is turned around the pin 74 in the clockwise direction as viewed in the figure by the link 78 being turned around the pin 82 in the clockwise direction as viewed in the figure, so as to be inclined in the same direction as the opening inclination of the clamps 25, as shown by a phantom line in FIG. 5.

In the embodiment shown in FIG. 4, an elastic strip sheet 90 is mounted to the movable circumferential wall member 66 as fixed at its rear edge portion 90*a*. Although the elastic strip sheet 90 is shown in FIG. 4 with about a half portion torn away for the purpose of illustrating the clamps 25, the elastic strip sheet 90 is provided to extend over the entire axial length of the back press roller 14, thereby covering all of the clamps 25. The elastic strip sheet 90 is formed with a plurality of cuts 90*b* at positions not overlapping with the side edges of the clamps, so that any portion of the elastic strip sheet may be easily lifted for a maintenance or inspection of the clamps.

The link mechanism composed of the L-shaped link 72 and the links 64, 78 and 84 is provided at another axial end portion of the back press roller 14 not seen in FIG. 4 to be symmetrical to those seen in the front side of the back press roller in FIG. 4, so that such a pair of links 64 are firmly connected by the shaft 62, while a pair of the free end portions of the leg portions 72*a* of such a pair of L-shaped links 72 are firmly connected by a rod 92, thereby ensuring that the clamps 25 and the movable circumferential wall member 66 are synchronously driven at the axially opposite ends by a driving force applied to the pin 88.

Although the present invention has been described in detail with respect to a particular embodiment thereof, partially incorporating a modification thereof, other various modifications of the shown embodiment will be readily possible by those skilled in the art, particularly with respect to shifting the movable circumferential wall member 66 rearward relative to the clamps in synchronization with the opening operation of the clamps and the mechanism for inclining the movable circumferential wall member in the same direction as the opening inclination of the clamps during the rearward biasing.

What is claimed is:

1. A stencil printer comprising a printing drum having a perforated construction in a circumferential portion thereof excluding two annular edge portions at opposite ends of a cylindrical configuration and a stencil sheet leading end mounting bar portion extending between the two annular edge portions along a generatrix of the cylindrical configuration, an inking roller provided inside the printing drum to supply ink to the perforated circumferential portion of the printing drum from the inside thereof, and a back press roller having a cylindrical outer configuration and a print sheet leading end holding clamp in an outer circumferential surface thereof along a generatrix thereof such that a part of the cylindrical outer configuration thereof is provided by the print sheet leading end holding clamp at an outer surface thereof when the clamp is in a closed position, the printing drum and the back press roller being arranged close and in parallel to one another to be rotated mutually in opposite rotational directions, so as to apply a stencil printing onto a print sheet transferred through a nip region between the printing drum and the back press roller with a leading end thereof being held by the clamp, the stencil printing being formed by the ink supplied from the inking roller to flow across the perforated portion of the printing drum and a perforated stencil sheet wrapped around the printing drum, wherein a portion of the outer circumferential surface of the back press roller in an area thereof adjacent to rear and opposite side edges of the outer surface of the clamp as viewed in a direction of movement of the outer circumferential surface of the back press roller due to the rotation thereof is provided by a circumferential wall member at an outer surface thereof conforming to the cylindrical outer configuration of the back press roller, the circumferential wall member being connected to the back press roller to be movable relative thereto and to the clamp, so as to be closely adjacent to the rear and opposite side edges of the outer surface of the clamp in operation with the outer surface thereof aligning to the outer surface of the clamp along the cylindrical outer configuration of the back press roller and biased rearward relative to the clamp as viewed in the direction of the movement of the outer circumferential surface of the back press roller when the clamp is opened from the closed position.

2. A stencil printer according to claim 1, wherein the circumferential wall member is constructed to incline in a same angular direction as the clamp when the member biases rearward relative to the clamp, and an elastic strip member is mounted to the circumferential wall member so as to cover the clamp when the clamp is closed.

3. A stencil printer according to claim 1, wherein the back press roller has a shaft extending adjacent to the outer circumferential surface thereof in parallel with a generatrix thereof to support the clamp, the clamp support shaft being supported from the back press roller to be rotatable around a central axis thereof and supporting the clamp to be rotatable therewith, a pair of L-shaped links arranged adjacent to opposite axial ends of the back press roller, the L-shaped links each having first and second leg portions and a hub portion therebetween and being supported to be rotatable around a central axis of the back press roller at the hub portion, the circumferential wall member being pivotably supported at opposite axial ends thereof by a pair of free end portions of the pair of first leg portions of the pair of L-shaped links, a pair of pins each planted to each of the opposite axial ends of the circumferential wall member at a position distant from the pivotal support position thereof to extend in the axial direction, a pair of brackets mounted to the opposite axial ends of the back press roller, a pair of first links each having a first end portion pivotably supported from each of the brackets and a second end portion formed with an opening for loosely receiving each of the pins, a pair of second links each having a first end portion torque transmittingly connected with each axial end of the clamp support shaft and a second end portion, a pair of third links each having a first end portion pivotably connected with the corresponding second end portion of each of the second links and a second end portion pivotably connected with a corresponding free end portion of each of the second leg portions of the L-shaped links, and a means for selectively driving at least one of the pair of second links to turn around the central axis of the clamp support shaft.

4. A stencil printer according to claim 3, wherein an elastic strip member is mounted to the circumferential wall member so as to cover the clamp when the clamp is closed.

* * * * *